US010252833B2

(12) United States Patent
Hao et al.

(10) Patent No.: US 10,252,833 B2
(45) Date of Patent: Apr. 9, 2019

(54) PACKAGE BOX AND LINER FOR THE SAME

(71) Applicants: BOE Technology Group Co., Ltd., Beijing (CN); Ordos Yuansheng Optoelectronics Co., Ltd., Inner Mongolia (CN)

(72) Inventors: Ruijun Hao, Beijing (CN); Pengjun Chen, Beijing (CN); Haijiang Wang, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 0 days.

(21) Appl. No.: 15/523,069

(22) PCT Filed: Jul. 8, 2016

(86) PCT No.: PCT/CN2016/089395
§ 371 (c)(1),
(2) Date: Apr. 28, 2017

(87) PCT Pub. No.: WO2017/124707
PCT Pub. Date: Jul. 27, 2017

(65) Prior Publication Data

US 2018/0105317 A1 Apr. 19, 2018

(30) Foreign Application Priority Data

Jan. 22, 2016 (CN) ..... 2016 2 0072766 U

(51) Int. Cl.
*B65D 81/05* (2006.01)
*B65D 5/50* (2006.01)
(Continued)

(52) U.S. Cl.
CPC ..... *B65D 5/509* (2013.01); *B65D 25/02* (2013.01); *B65D 25/10* (2013.01); *B65D 81/05* (2013.01); *B65D 81/07* (2013.01); *B65D 81/127* (2013.01)

(58) Field of Classification Search
CPC ..... B65D 5/509; B65D 81/05; B65D 81/07; B65D 5/0005; B65D 21/08; B65D 25/10; B65D 81/107
(Continued)

(56) References Cited

U.S. PATENT DOCUMENTS 1,120,955 A * 12/1914 Martin ..... B65D 5/0005 220/8
2,615,707 A * 10/1952 Rowe ..... F16F 15/067 217/54
(Continued)

FOREIGN PATENT DOCUMENTS

CN 203294485 U 11/2013
CN 203793845 U 8/2014
(Continued)

OTHER PUBLICATIONS

International Search Report and Written Opinion, including English translation of Box No. V of the Written Opinion, for International Application No. PCT/CN2016/089395, dated Oct. 26, 2016, 13 pages.

*Primary Examiner* — Steven A. Reynolds
(74) *Attorney, Agent, or Firm* — Westman, Champlin & Koehler, P.A.

(57) ABSTRACT

The present disclosure relates to a package box and a liner for the same. The package box includes a hexahedral outer box body; a cover configured to cover an opening of the outer box body; a substantially hexahedral liner placed in the outer box body and having six side walls, at least one of which side walls is configured to be a movable side wall,
(Continued)

each movable side wall being slidably coupled with the adjacent four side walls to change the volume of the liner; and at least one resilient member disposed between each movable side wall and the wall of the outer box body facing the movable side wall, or between each movable side wall and the cover respectively, to drive each movable side walls to move towards and to get in close contact with articles placed within the liner.

18 Claims, 7 Drawing Sheets

(51) Int. Cl.
*B65D 25/10* (2006.01)
*B65D 25/02* (2006.01)
*B65D 81/07* (2006.01)
*B65D 81/127* (2006.01)

(58) Field of Classification Search
USPC ..... 206/594, 591, 592, 583, 521
See application file for complete search history.

(56) References Cited

U.S. PATENT DOCUMENTS 2,696,322 A * 12/1954 Densen ..... B65D 81/07 206/521
2,932,546 A * 4/1960 Marggraf ..... B65D 81/07 206/583
2,965,371 A * 12/1960 Gulardo ..... B65D 81/07 206/591
3,003,622 A * 10/1961 Hardigg ..... B65D 81/07 206/521
3,635,332 A * 1/1972 Ross ..... B65D 81/07 206/477
3,754,803 A * 8/1973 Underwood ..... B65D 81/07 217/55
3,844,203 A * 10/1974 Takahashi ..... B65D 81/07 220/592.2
4,013,170 A * 3/1977 Hutterer ..... B65D 81/07 206/521
4,184,602 A * 1/1980 Moliard ..... B65D 21/08 160/229.1
4,355,791 A * 10/1982 Dean ..... F16F 1/32 206/591
4,574,955 A * 3/1986 Camossi ..... B65D 81/07 206/386
5,016,753 A * 5/1991 Henderson ..... B65D 5/0005 116/306
5,223,973 A * 6/1993 Ratzlaff ..... A45C 11/08 206/316.3
5,655,662 A * 8/1997 Garcia ..... B65D 7/24 206/453
5,855,291 A * 1/1999 Ingle ..... B60R 7/02 220/4.03
5,904,251 A 5/1999 Ogata et al.
7,516,597 B1 * 4/2009 Roose ..... B65B 55/20 53/139.5
7,658,281 B2 * 2/2010 Eichenberger ..... B65D 81/07 206/301
9,738,429 B2 * 8/2017 Buelna ..... B65D 81/07
9,939,041 B2 * 4/2018 Kronkright ..... F16F 15/04

FOREIGN PATENT DOCUMENTS

CN 105151483 A 12/2015
CN 204822408 U 12/2015

* cited by examiner

PACKAGE BOX AND LINER FOR THE SAME

CROSS-REFERENCE TO RELATED APPLICATION

This application is a Section 371 National Stage Application of International Application No. PCT/CN2016/089395, filed on 8 Jul. 2016, which has not yet published, and claims priority to Chinese Patent Application No. 2016200727665 filed on Jan. 22, 2016 in the State Intellectual Property Office of China, the disclosures of which are incorporated herein by reference in their entirety.

FIELD OF THE INVENTION

The present invention relates to a package box, especially to a package box for containing a plate-like article and a liner for the package box.

DESCRIPTION OF THE RELATED ART

In the prior art, a package box for containing a plate like article generally comprises an casing, sizes of which are substantially constant, and thus articles which may be of various sizes may not be accommodated within one same package box, such that packaging cost, stock management cost, and recycling cost of the package box are relatively high. As such, a certain size margin is generally required to be retained in design to prevent deformation of a box body due to the factors such as environmental temperature and humidity during transporting and storage thereof, which may result in difficulties in packaging. As such, a relatively large gap may be created between the articles and the box body. In case that the box body is subjected to an impact, defects/imperfections (such as scratches and the like) may be created on the articles due to a relative movement thereamong, and the articles may also be damaged due to a secondary impact. Finally, existing package boxes for the plate like article generally have a disadvantage of insufficient cushioning and of a poor transportation quality.

SUMMARY OF THE INVENTION

A package box and a liner for the same are provided by embodiments of the present disclosure. By providing a volume-adjustable liner within an outer box body, the articles contained in the liner may be secured so as to prevent the articles from moving within the liner.

According to an aspect of the present invention, there is provided a package box comprising, a hexahedral outer box body; a cover configured to cover an opening of the outer box body; a substantially hexahedral liner placed in the outer box body and having six side walls, at least one of which side walls is configured to be a movable side wall, each movable side wall being slidably engaged with four adjacent side walls to change the volume of the liner; and at least one resilient member disposed between each movable side wall and the wall of the outer box body facing the movable side wall respectively, or between each movable side wall and the cover respectively, to drive each movable side walls to move to get in close contact with articles placed within the liner.

According to an embodiment of the present disclosure, at least one pair of opposing edges of each movable side walls are provided with at least one groove or at least one protrusion, and edges of at least one pair of opposing side walls of four side walls which are adjacent to the movable side wall are provided with at least one mating protrusion or at least one mating groove, wherein the mating protrusion is slidably engaged with the groove in a direction or two mutually perpendicular directions, and the mating groove is slidably engaged with the protrusion in a direction or two mutually perpendicular directions.

According to an embodiment of the present disclosure, at least one of a depth of the groove and the mating groove, and an extension length of the protrusion and the mating protrusion is larger than a thickness of the side walls.

According to an embodiment of the present disclosure, each edge of a bottom wall or a top wall of the six side walls is provided with the grooves; and an edge of a pair of longitudinal walls and a pair of transverse walls of the six side walls which are adjacent to the bottom wall or the top wall are provided with the mating protrusions which are engaged with the grooves of the bottom wall or the top wall; the edges of the transverse walls which are adjacent to the longitudinal walls are provided with grooves and the edges of the longitudinal walls which are adjacent to the transverse walls are provided with mating protrusions which are engaged with the grooves of the transverse walls.

According to an embodiment of the present disclosure, an extension length of the protrusions provided at the edge of the transverse walls which are adjacent to the bottom wall or the top wall is equivalent to the thickness of the side walls.

According to an embodiment of the present disclosure, an extension length of the protrusions provided at edges of the transverse wall which are adjacent to the bottom wall or the top wall is greater than the thickness of the side walls.

According to an embodiment of the present disclosure, the six side walls are configured to be elastic walls.

According to an embodiment of the present disclosure, the resilient member is connected to the outside of the liner, or to the inside of the outer box body and/or the cover.

According to an embodiment of the present disclosure, the resilient member comprises a fixed cylinder, one end of which is provided with a fixed seat mounted to the outside of a corresponding movable side wall or mounted to a corresponding wall of the outer box body; a movable portion protruded from the other end of the fixed cylinder; and a spring mounted in the fixed cylinder to drive the movable portion to move relative to the fixed cylinder.

According to an embodiment of the present disclosure, the resilient member comprises a bellows or an air spring.

According to an embodiment of the present disclosure, the resilient member comprises a tension spring connected between the two opposite side walls outside of the liner.

According to another aspect of the present invention, there is provided a liner for a package box which is substantially in a hexahedral shape, and at least one of the six side walls of the liner is configured to be a movable side wall, each movable side wall being slidably engaged with four adjacent side walls to change the volume of the liner; and at least one resilient member disposed outside of each movable side walls to drive each movable side walls to move towards and to get in close contact with articles placed within the liner.

According to an embodiment of the present disclosure, at least one pair of opposing edges of each movable side walls are provided with at least one groove or at least one protrusion, and edges of at least one pair of opposing side walls of four side walls which are adjacent to the movable side wall is provided with at least one mating protrusion or at least one mating groove, wherein the mating protrusion is slidably engaged with the groove in a direction or two mutually perpendicular directions, and the mating groove is slidably engaged with the protrusion in a direction or two mutually perpendicular directions.

According to an embodiment of the present disclosure, at least one of a depth of the groove and the mating groove, and an extension length of the protrusion and the mating protrusion is larger than a thickness of the side walls.

According to an embodiment of the present disclosure, each edge of the bottom wall or the top wall of the six side walls is provided with the grooves; and edges of a pair of longitudinal walls and a pair of transverse walls of the six side walls which are adjacent to the bottom wall or the top wall are provided with the mating protrusions which are engaged with the grooves of the bottom wall or the top wall; the edges of the transverse walls which are adjacent to the longitudinal walls are provided with grooves and the edges of the longitudinal walls which are adjacent to the transverse walls are provided with mating protrusions which are engaged with the grooves of the transverse walls.

According to an embodiment of the present disclosure, an extension length of the protrusions provided at the edges of the transverse walls which are adjacent to the bottom wall or the top wall is equivalent to the thickness of the side walls.

According to an embodiment of the present disclosure, an extension length of the protrusions provided at edges of the transverse walls which are adjacent to the bottom wall or the top wall is greater than the thickness of the side walls.

According to an embodiment of the present disclosure, the six side walls are configured to be elastic walls.

According to an embodiment of the present disclosure, the resilient member comprises a fixed cylinder, one end of which is provided with a fixed seat mounted to the outside of a corresponding movable side wall; a movable portion protruded from the other end of the fixed cylinder; and a spring mounted in the fixed cylinder to drive the movable portion to move relative to the fixed cylinder.

According to an embodiment of the present disclosure, the resilient member comprises a bellows or an air spring.

According to an embodiment of the present disclosure, the resilient member comprises a tension spring connected between the two opposite side walls outside of the liner.

BRIEF DESCRIPTION OF THE DRAWINGS

The present disclosure will now be further described in detail with reference to the embodiments, taken in conjunction with the accompanying drawings, so as to clearly understand the purposes, technical solutions and advantages of the present disclosure, in which.

DETAILED DESCRIPTION OF PREFERRED EMBODIMENTS OF THE INVENTION

Figure 1:
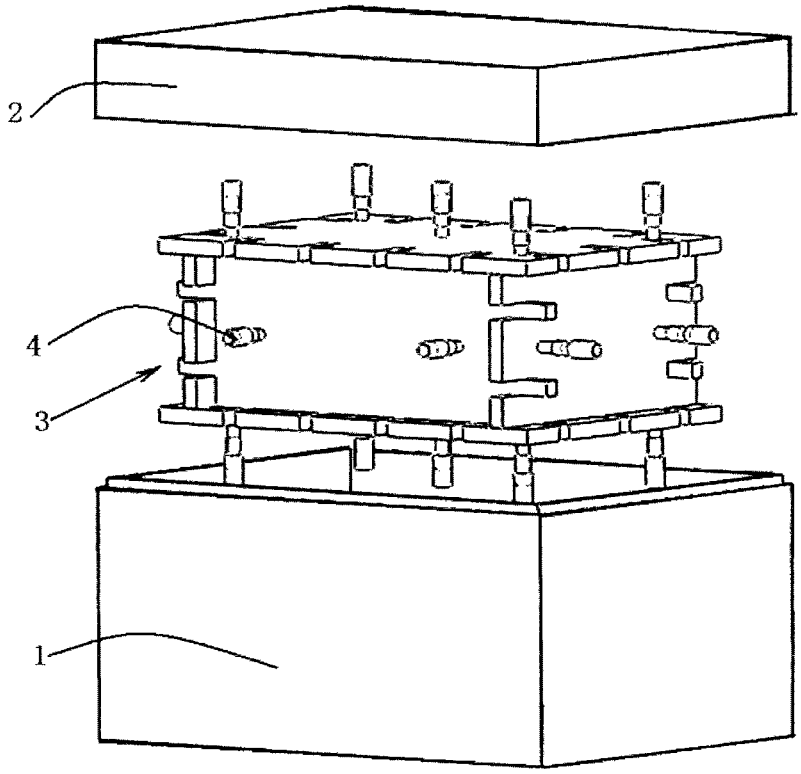
FIG. 1 is an exploded schematic view of a package box according to an exemplary embodiment of the present disclosure.

The technical solution of the present disclosure will be further described in detail with reference to the following embodiments, taken in conjunction with the accompanying drawings. In the specification, the same or similar reference numerals indicate the same or similar parts. The following is an explanation of the general idea of the present disclosure with reference to the accompanying drawings, and is not to be construed as limiting the present disclosure.

According to a general concept of the present disclosure, there is provided a package box comprising, a hexahedral outer box body; a cover configured to cover an opening of the outer box body; a substantially hexahedral liner placed in the outer box body and having six side walls, at least one of which side walls is configured to be a movable side wall, each movable side wall being slidably engaged with four adjacent side walls to change the volume of the liner; and at least one resilient member disposed between each movable side wall and the wall of the outer box body facing the movable side wall respectively, or between each movable side wall and the cover respectively, to drive each movable side walls to move towards an article placed within the liner and get in close contact with the article.

In the following detailed description, for purposes of explanation, numerous specific details are set forth in order to provide a thorough understanding of the disclosed embodiments. It will be apparent, however, that one or more embodiments may also be implemented without these specific details. In other instances, well-known structures and devices are embodied by way of illustration to simplify the drawings.

Figure 2:
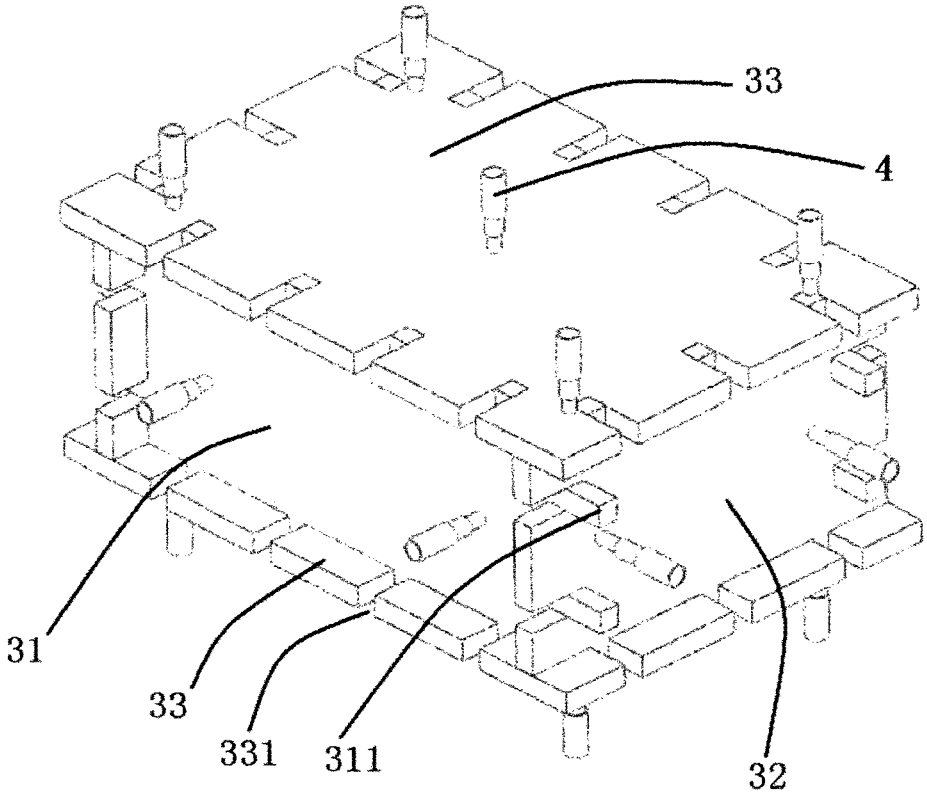
FIG. 2 is a schematic perspective view of a liner for a package box according to an exemplary embodiment of the present disclosure.

FIG. 1 is an exploded schematic view of a package box according to an exemplary embodiment of the present disclosure and FIG. 2 is a schematic perspective view of a liner for a package box according to an exemplary embodiment of the present disclosure. As shown in FIGS. 1 and 2, the package box according an embodiment of the present disclosure is adapted to contain the plate-like articles such as a liquid crystal panel, an array substrate, a glass substrate and the like, but the present disclosure is not limited thereto. It will be understood by those skilled in the art that the package box of the present disclosure may also contain non-plate-like articles, or regularly or irregularly shaped articles such as a display, a charger and the like.

As shown in FIGS. 1 and 2, the package box according to an exemplary embodiment of the present disclosure comprises a hexahedral (for example in a form of a substantial cuboid or cube shape) outer box body 1 made of metal or hard plastic material; a cover 2 configured to cover an opening of the outer box body 1; a hexahedral (for example in a form of a substantial cuboid or cube) liner 3 placed in the outer box body 1 and having six side walls, and at least one resilient member 4. The liner 3 is placed in the outer box body 1 and the cover 3 covers the opening of the outer box body 1, such that a closed outer box body is formed. At least one of the six side walls of the liner 3 is configured to be a movable side wall, each movable side wall being slidably engaged with four adjacent side walls to change a volume of the liner 3. The resilient members are disposed between each movable side wall and the corresponding wall of the outer box body 1 facing the movable side wall respectively, or between each movable side wall and the cover 2 respectively, to drive each movable side wall to move towards and to get in close contact with articles placed within the liner 3.

Since the hexahedron liner has six side walls, it may be understood that the movement of at least one of the two side walls with respect to the other side walls under the elastic force of the resilient member 4 may change the volume of the liner, until the driven movable side wall comes into contact with the articles within the liner. As such, the articles contained in the liner 3 may be completely fixed by providing a volume-adjustable liner 3 in the outer box body 1 so as to prevent the article from moving within the liner 3, thereby preventing the article from being damaged due to an impact, and avoiding defects such as scratches and other undesirable phenomena due to the articles' relative movements. Further, in a case that the outer box body has same dimensions, articles with a variety of sizes may be contained by changing the volume of the liner, expanding the application scope of the package box.

Figure 3:
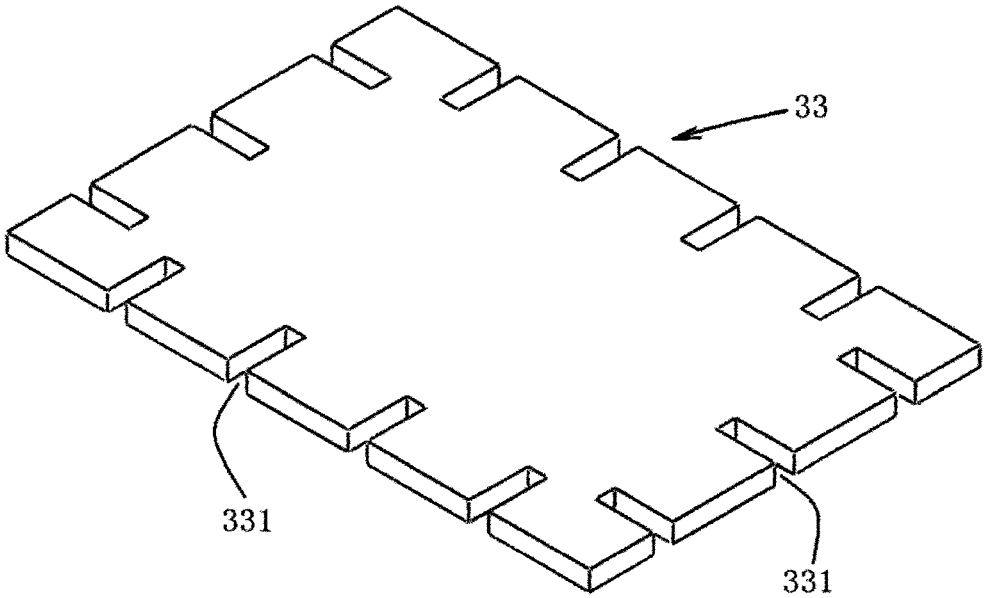
FIG. 3 is a schematic perspective view of a bottom wall or a top wall of a liner according to an exemplary embodiment of the present disclosure.
Figure 4:
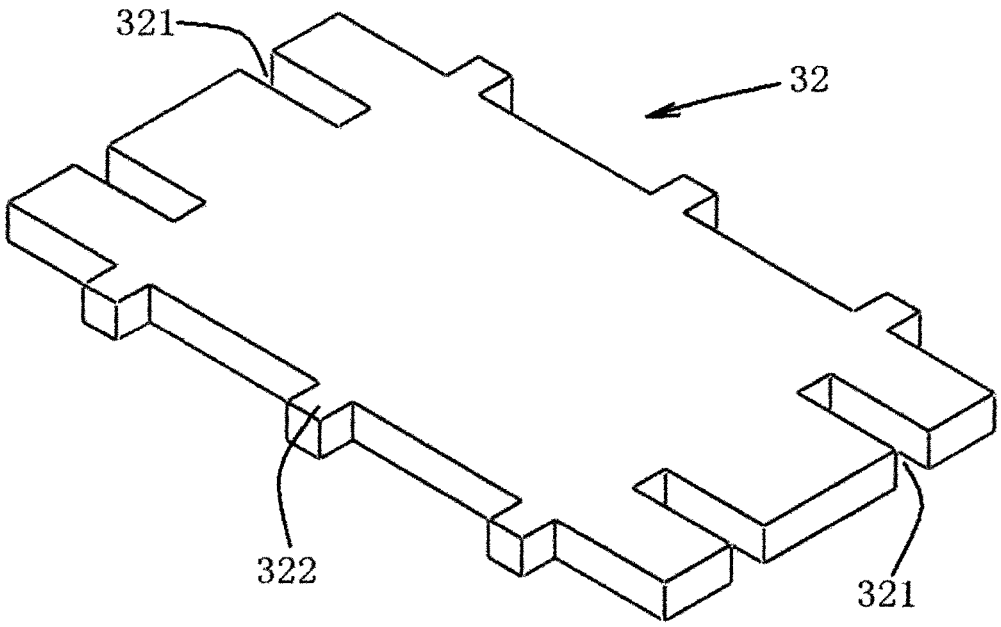
FIG. 4 is a schematic perspective view of a transverse wall of a liner according to an exemplary embodiment of the present disclosure.
Figure 5:
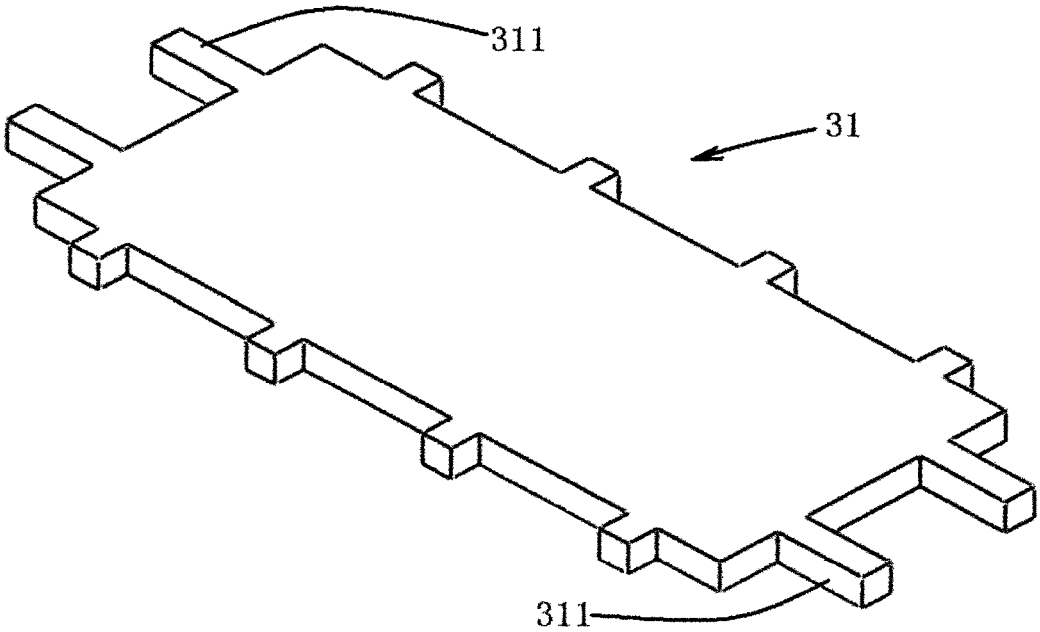
FIG. 5 is a schematic perspective view of a longitudinal wall of a liner according to an exemplary embodiment of the present disclosure.
Figure 6:
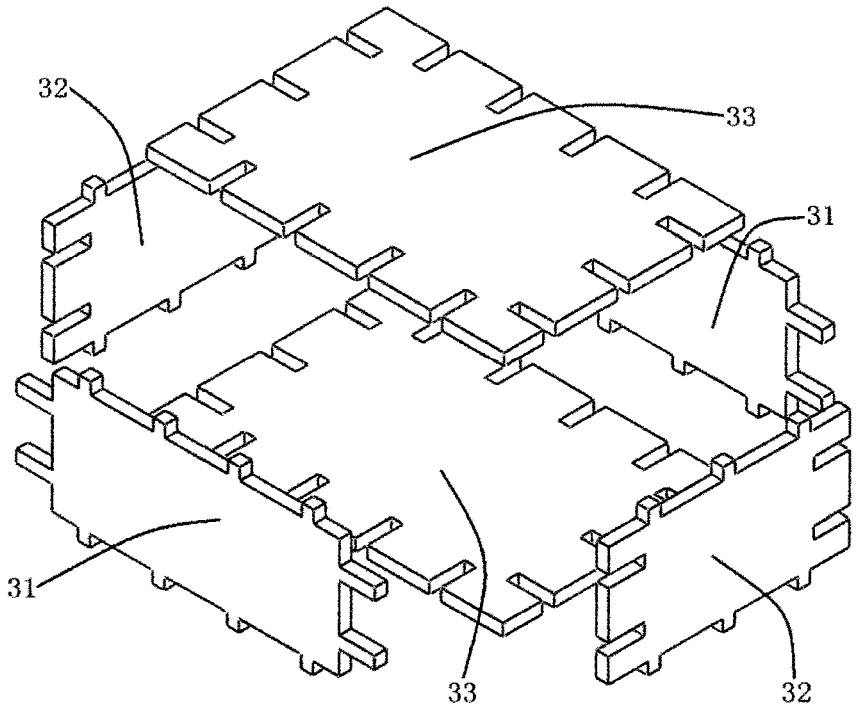
FIG. 6 is an exploded schematic view of a liner according to an exemplary embodiment of the present disclosure in which a resilient member is omitted.

As shown in FIGS. 1-8, the cuboid-shaped liner 3 includes two longitudinal walls 31, two transverse walls 32 and two top or bottom walls 33. For convenience of description, the transverse walls 32 are provided as movable side walls, and four side walls adjacent to the movable side walls comprise two longitudinal walls 31 and two top or bottom walls 33. In an exemplary embodiment, as shown in FIGS. 2, 4 and 6, at least one pair of opposing edges of each of the movable side walls are provided with at least one groove or at least one protrusion. For example, a pair of opposing edges (e.g., transverse edges) of the transverse walls 32 which are provided as movable side walls are provided with at least one groove, and another pair of edges (e.g., longitudinal edges) are provided with at least one protrusion 322. The edges of at least one pair of opposing wall of the four side walls adjacent to the movable side walls are provided with at least one mating protrusion or at least one mating groove. For example, as shown in FIGS. 2, 3 and 6, the transverse edges of the bottom wall or the top wall 33 adjacent to the transverse walls 32 which are provided as the movable side walls are provided with mating grooves 331, as shown in FIGS. 2, 5 and 6, and the transverse edges of the longitudinal walls 31 adjacent to the transverse walls 32 which are provided as movable side walls are provided with fitting protrusions 311. The mating projections 311 of the longitudinal walls 31 and the grooves 321 of the transverse walls 32 are slidably engaged in one direction or two mutually perpendicular directions, and the mating grooves 331 of the bottom wall or the top wall 33 and the projections 322 of the transverse walls 32 are slidably engaged in one direction or two mutually perpendicular directions. The side walls of the liner of the present embodiment are joined together by engagement of grooves and protrusions, forming a simple construction, facilitating the manufacture, assembly and disassembly thereof, and reducing the cost of manufacture and utility thereof.

It is to be noted that, merely for the sake of convenience, the groove structure may be divided into a groove and a mating groove and the protrusion structure may be divided into a protrusion and a mating protrusion. It will be appreciated that the mating groove may also be referred to as the groove, and the mating protrusion may also be referred to as the protrusion.

In an embodiment, at least one of a depth of the groove and the mating groove, and an extension length of the protrusion and the mating protrusion is larger than a thickness of the side wall. It is to be understood that in the engagement mode of the groove and the projection, the protrusion inserted into the groove is allowed to move in a predetermined range in the depth direction of the groove if the depth of the groove is greater than the thickness of the side walls, and the projection inserted into the groove is allowed to move in a predetermined range in the thickness direction of the side wall, if the extension length of the mating protrusion is greater than the thickness of the side walls; furthermore, the protrusion inserted into the groove is allowed to move in a predetermined range in both the depth direction of the groove and the thickness direction of the side wall if the depth of the groove is larger than the thickness of the side walls and the extension length of the mating protrusion is also larger than the thickness of the side walls. As such, at least one of the six side walls may be moved in a simple structure by allowing the protrusion to move in the groove in the thickness direction of the side wall and/or in the depth direction of the groove.

In an embodiment, as shown in FIGS. 1-8, each edge of the bottom wall or the top wall 33 of the six side walls is provided with the grooves; and edges of a pair of longitudinal walls 31 and a pair of transverse walls 32 of the six side walls which are adjacent to the bottom wall or the top wall 31 are provided with the mating protrusions which are engaged with the grooves of the bottom wall or the top wall 33; the edges of the transverse walls 32 which are adjacent to the longitudinal walls are provided with grooves and the edges of the longitudinal walls 31 which are adjacent to the transverse walls are provided with mating protrusions which are engaged with the grooves of the transverse walls 32.

It will be appreciated that the arrangements of the mating grooves and protrusions are interchangeable in a manner in which the adjacent side walls are interconnected through the grooves and protrusions. The positions of the grooves and the projections may be set as desired, and the two adjacent side walls may be joined together as long as there are grooves and protrusions which may be engaged with each other in the two adjacent side walls. Thus, the engagement of such grooves and protrusions also increases the flexibility of the liner design.

Figure 7:
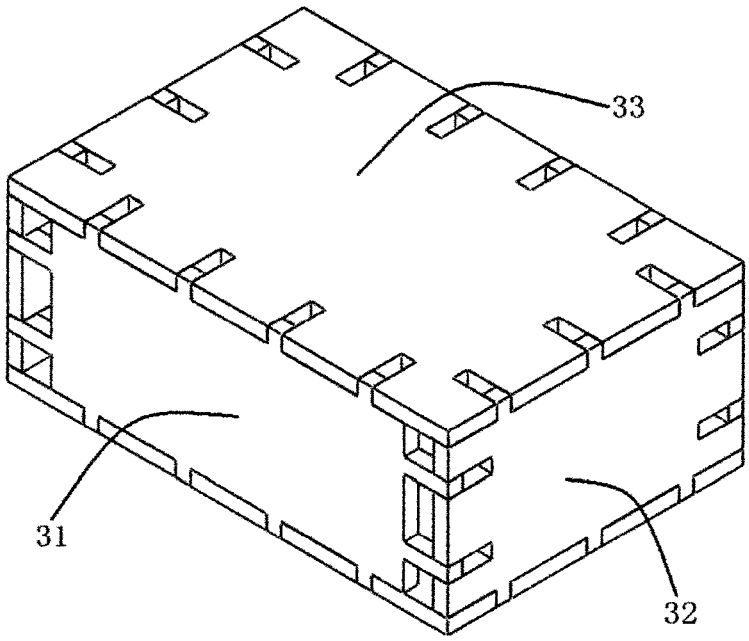
FIG. 7 is a schematic perspective view of a liner according to an exemplary embodiment of the present disclosure in a configuration in which a resilient member is not shown.
Figure 8:
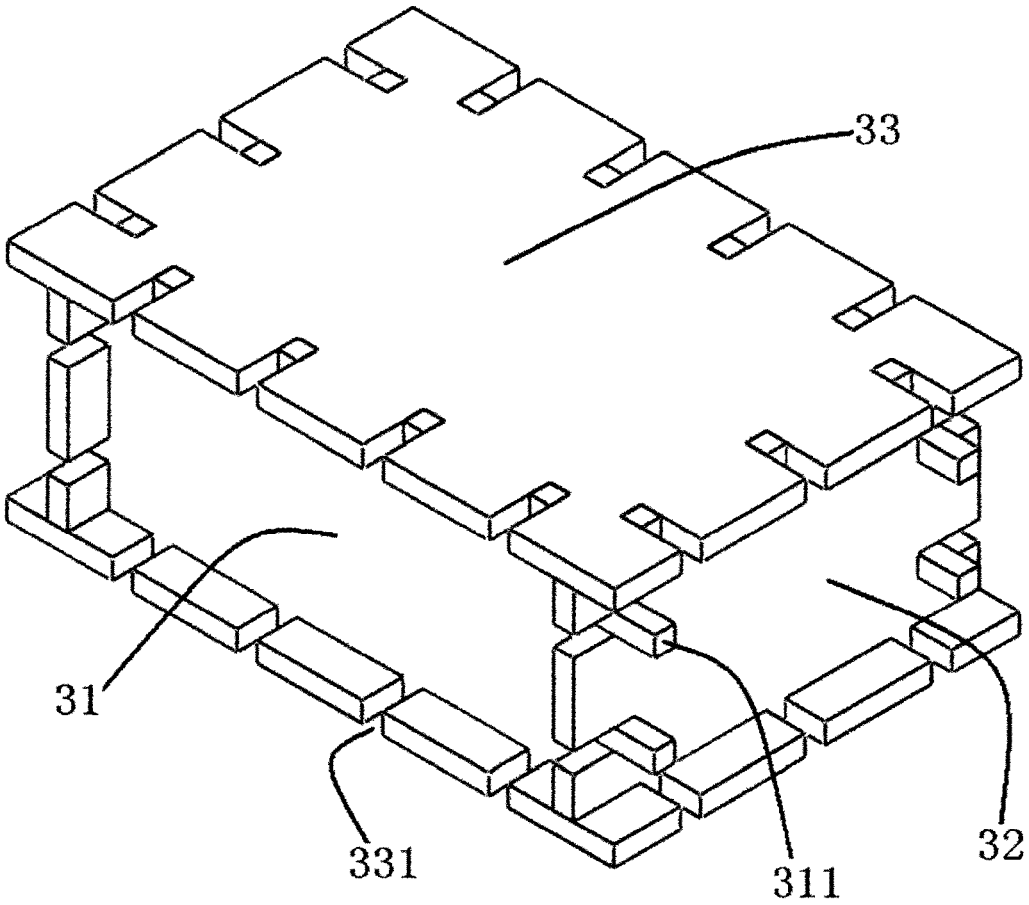
FIG. 8 is a schematic perspective view of a liner according to an exemplary embodiment of the present disclosure in another configuration in which a resilient member is omitted.

In an embodiment, as shown in FIGS. 4, 7 and 8, an extension length of the protrusions 322 provided at the edge of the transverse walls 32 which are adjacent to the bottom wall or the top wall 33 is equivalent to the thickness of the side walls. As such, the movement of the bottom wall or the top wall 33 may be restricted when the projections 322 of the transverse walls 32 are engaged with the mating grooves 331 of the bottom wall or the top wall 33.

In an alternative embodiment, an extension length of the protrusions provided at edges of the transverse walls which are adjacent to the bottom wall or the top wall is greater than the thickness of the side walls. As such, the bottom wall or the top wall 33 is allowed to move when the projections 322 of the transverse walls 32 are engaged with the mating grooves 331 of the bottom wall or the top wall 33.

In an embodiment, the six side walls of the liner 3 are elastic walls which for example are made of foam material. As such, the articles in the liner are allowed to contact the side walls of the liner elastically, reducing the impact on the articles, and protecting the articles in the liner from being damaged.

In an embodiment, as shown in FIGS. 1 and 2, one end of each resilient member 4 is connected to the outside of the liner 3. In an alternative embodiment, one end of each resilient member 4 is connected to the inside of the outer box body and/or the cover. As such, it is convenient to fix the elastic member so as to position the liner stably.

Figure 9:
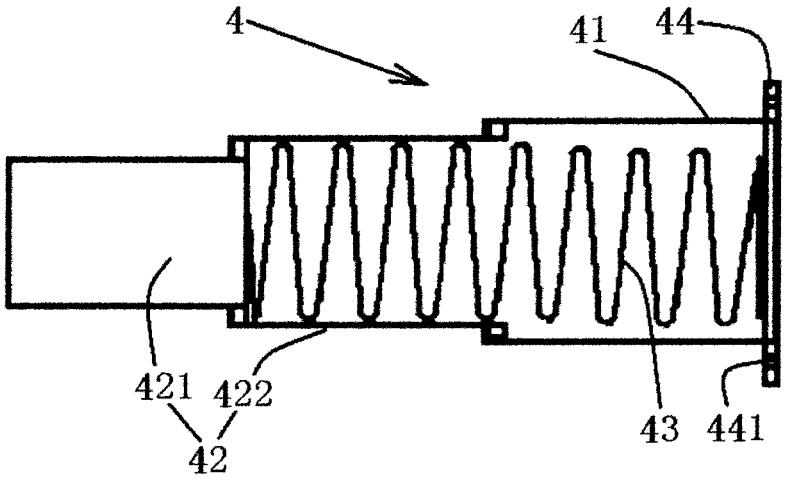
FIG. 9 is a longitudinal sectional view of a resilient member according to an exemplary embodiment of the present disclosure.
Figure 10:
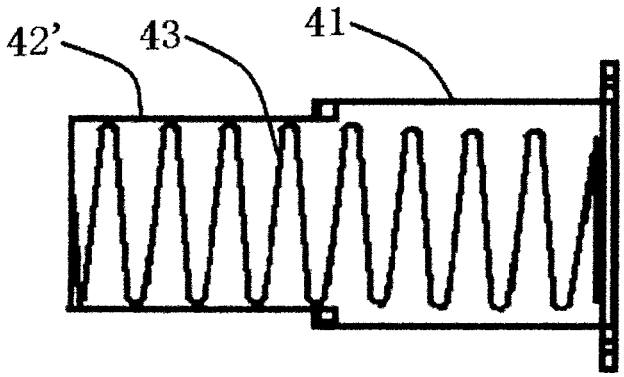
FIG. 10 is a longitudinal sectional view of a resilient member according to another exemplary embodiment of the present disclosure.
Figure 11:
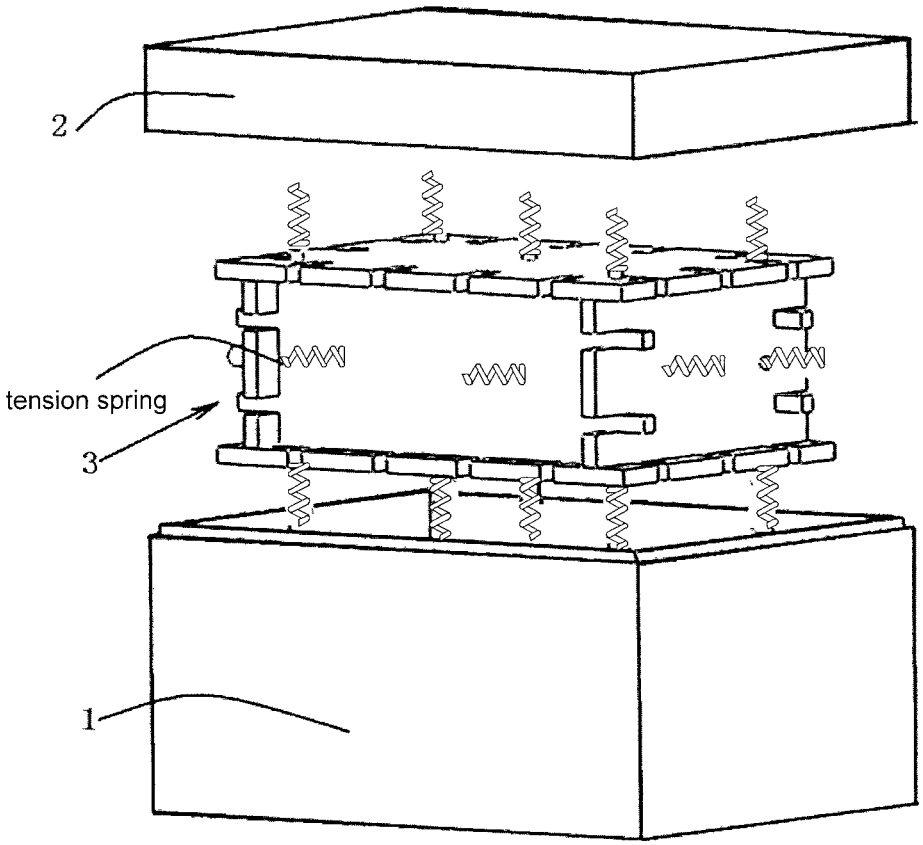
FIG. 11 is an exploded schematic view of a package box according to another exemplary embodiment of the present disclosure, in which the resilient members are tension springs.

In an embodiment, as shown in FIGS. 9 and 10, each resilient member 4 comprises a fixed cylinder 41, a movable portion 42 and a spring 43. One end of the fixed cylinder 41 is provided with a fixed seat 44 mounted to outside of a corresponding movable side wall or mounted to a corresponding wall of the outer box body 1 so as to mount the resilient member 4 to outside of the liner 3, or inside of the outer box body 1 and/or cover 2 via a through hole 441 on the fixed seat 44. It is also possible to mount the resilient member 4 to outside of the liner 3 or inside the outer box body 1 and/or the cover 2 in a manner of bonding. The movable portion 42 protrudes from the other end of the fixed cylinder 41. The spring 43 is mounted in the fixed cylinder 41 to drive the movable portion 42 to move relative to the fixed cylinder 41. In an embodiment illustrated in FIG. 9, the movable portion 42 comprises a hollow cylinder portion 422 and a solid cylinder portion 421 connected to one end of the hollow cylinder portion. The hollow cylinder portion 422 protrudes from the solid cylinder 41, and the spring 43 partially extends to the hollow cylinder portion 422. In an embodiment illustrated in FIG. 10, the movable portion 42' is configured to be a hollow cylinder portion and protrudes from the fixed cylinder 41, and the spring 43 partially extends to the hollow cylinder portion. In an alternative embodiment, the resilient member 4 comprises a bellows or an air spring. In another alternative embodiment, the resilient member comprises a tension spring connected between the two opposite side walls outside of the liner, as shown in FIG. 11.

As such, when the article is placed in the liner, the corresponding side wall of the liner may be expanded outward and the resilient members may be compressed to increase the volume of the liner, thereby the articles may be placed successfully in the liner. Next, the force to expand the side wall is removed, the side walls are moved inwardly driven by the elastic restoring force of the resilient member, and gradually contact and press the articles in the liner, thereby stably holding the article in the liner, and preventing the articles from being moved.

According to another aspect of the present invention, there is provided a liner 3 for a package box which is substantially in a hexahedral shape, and at least one of the six side walls of the liner 3 is configured to be a movable side wall, each movable side wall being slidably engaged with four adjacent side walls to change the volume of the liner; and at least one resilient member 4 disposed outside of each movable side walls to drive each movable side wall to move towards articles placed within the liner 3 and to get in close contact with the article 3 so as to prevent the article from being moved in the liner, and prevent the articles from being damaged due to an impact, and avoiding scratches and other undesirable phenomena due to the articles' relative movements. Further, the liner may contain articles with a variety of sizes.

The package box and the liner for the same according to embodiments of the present disclosure, by providing a volume-adjustable liner within the outer box body, the articles contained in the liner may be completely secured so as to prevent the articles from moving within the liner. Therefore, the articles are protected from being damaged by impacts and scratches are avoided due to the articles' relative movements. Further, the package box may contain articles of various sizes.

The objects, technical solutions and advantageous effects of the present disclosure have been described in detail with reference to the specific embodiments described above. It is to be understood that the foregoing description is merely of the specific embodiments of the present disclosure and is not intended to limit the present disclosure, and that any modifications, equivalent substitutions, improvements, etc., within the spirit and principles of the present disclosure are included within the scope of the present disclosure.

What is claimed is:

1. A package box comprising, a hexahedral outer box body;

a cover configured to cover an opening of the outer box body;

a substantially hexahedral liner placed in the outer box body and having six side walls, at least one of which side walls is configured to be a movable side wall, the at least one movable side wall being slidably engaged with four adjacent side walls to change the volume of the liner; and at least one resilient member disposed between the at least one movable side wall and a wall of the outer box body facing the movable side wall respectively, or between the at least one movable side wall and the cover respectively, so as to drive the at least one movable side wall to move towards articles placed within the liner and to get in close contact with the articles, each edge of a bottom wall or a top wall of the six side walls is provided with grooves; and edges of a pair of longitudinal walls and a pair of transverse walls of the six side walls which are adjacent to the bottom wall or the top wall are provided with mating protrusions which are engaged with the grooves of the bottom wall or the top wall; the edges of the transverse walls which are adjacent to the longitudinal walls are provided with grooves and the edges of the longitudinal walls which are adjacent to the transverse walls are provided with mating protrusions which are engaged with the grooves of the transverse walls.

2. The package box according to claim 1, wherein the mating protrusion is slidably engaged with the at least one groove in a direction or two mutually perpendicular directions, and the mating groove is slidably engaged with the at least one protrusion in a direction or two mutually perpendicular directions.

3. The package box according to claim 2, wherein at least one of a depth of the at least one groove and the mating groove, and an extension length of the at least one protrusion and the mating protrusion is larger than a thickness of the side walls.

4. The package box according to claim 1, wherein an extension length of the protrusions provided at the edge of the transverse walls which are adjacent to the bottom wall or the top wall is equivalent to the thickness of the side walls.

5. The package box according to claim 1, wherein
an extension length of the protrusions provided at edges of the transverse walls which are adjacent to the bottom wall or the top wall is greater than the thickness of the side walls.

6. The package box according to claim 1, wherein
the six side walls are elastic walls.

7. The package box according to claim 1, wherein
the at least one resilient member is connected to the outside of the liner, or to the inside of the outer box body and/or the cover.

8. The package box according to claim 7, wherein the at least one resilient member comprises
a fixed cylinder, one end of which is provided with a fixed seat mounted to the outside of a corresponding movable side wall or mounted to a corresponding wall of the outer box body;
a movable portion protruded from the other end of the fixed cylinder; and
a spring mounted in the fixed cylinder to drive the movable portion to move relative to the fixed cylinder.

9. The package box according to claim 7, wherein the at least one resilient member comprises a bellows or an air spring.

10. The package box according to claim 7, wherein the at least one resilient member comprises a tension spring connected between the two opposite side walls outside of the liner.

11. A liner for a package box which is substantially in a hexahedral shape, and at least one of the six side walls of the liner is configured to be a movable side wall, the at least one movable side wall being slidably engaged with four adjacent side walls to change the volume of the liner; and
at least one resilient member disposed outside of the at least one movable side wall to drive the at least one movable side wall to move towards and to get in close contact with articles placed within the liner,
each edge of the bottom wall or the top wall of the six side walls is provided with grooves; and edges of a pair of longitudinal walls and a pair of transverse walls of the six side walls which are adjacent to the bottom wall or the top wall are provided with mating protrusions which are engaged with the grooves of the bottom wall or the top wall; the edges of the transverse walls which are adjacent to the longitudinal walls are provided with grooves and the edges of the longitudinal walls which are adjacent to the transverse walls are provided with mating protrusions which are engaged with the grooves of the transverse walls.

12. The liner according to claim 11, wherein
the mating protrusion is slidably engaged with the at least one groove in a direction or two mutually perpendicular directions, and the mating groove is slidably engaged with the at least one protrusion in a direction or two mutually perpendicular directions.

13. The liner according to claim 12, wherein
at least one of a depth of the at least one groove and the mating groove, and an extension length of the at least one protrusion and the mating protrusion is larger than a thickness of the side walls.

14. The liner according to claim 11, wherein
an extension length of the protrusions provided at the edges of the transverse walls which are adjacent to the bottom wall or the top wall is equivalent to the thickness of the side walls.

15. The liner according to claim 11, wherein
an extension length of the protrusions provided at edges of the transverse walls which are adjacent to the bottom wall or the top wall is greater than the thickness of the side walls.

16. The liner according to claim 11, wherein
the six side walls are elastic walls.

17. The liner according to claim 11, wherein the at least one resilient member comprises
a fixed cylinder, one end of which is provided with a fixed seat mounted to the outside of a corresponding movable side wall;
a movable portion protruded from the other end of the fixed cylinder; and
a spring mounted in the fixed cylinder to drive the movable portion to move relative to the fixed cylinder.

18. The liner according to claim 17, wherein the at least one resilient member comprises a bellows or an air spring, or a tension spring connected between the two opposite side walls outside of the liner.

* * * * *